US009399842B2

(12) United States Patent
Thieme et al.

(10) Patent No.: US 9,399,842 B2
(45) Date of Patent: Jul. 26, 2016

(54) TEXTURE CURING MACHINE AS WELL AS METHOD FOR THE SUBSEQUENT TREATMENT OF A FRESHLY PRODUCED CONCRETE LAYER

(71) Applicant: Wirtgen GmbH, Windhagen (DE)

(72) Inventors: Holger Thieme, Vettelschoss (DE); Harry Wenzelmann, Alpenrod (DE); Markus Zimmermann, Rhein (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/571,597

(22) Filed: Dec. 16, 2014

(65) Prior Publication Data

US 2015/0176229 A1 Jun. 25, 2015

(30) Foreign Application Priority Data

Dec. 23, 2013 (DE) ..... 102013021786
Jul. 2, 2014 (DE) ..... 102014212853

(51) Int. Cl.

| | |
|---|---|
| ***E01C 19/00*** | (2006.01) |
| ***E01C 23/08*** | (2006.01) |
| ***E01C 19/43*** | (2006.01) |
| ***E01C 19/46*** | (2006.01) |
| ***E01C 19/48*** | (2006.01) |
| ***E01C 23/06*** | (2006.01) |

(52) U.S. Cl.

CPC ..... *E01C 23/08* (2013.01); *E01C 19/43* (2013.01); *E01C 19/46* (2013.01); *E01C 19/48* (2013.01); *E01C 23/06* (2013.01)

(58) Field of Classification Search

CPC ..... E01C 19/43; E01C 19/46; E01C 19/48; E01C 23/06; E01C 23/08
USPC ..... 404/89, 93, 94, 101, 108, 111, 75, 83
See application file for complete search history.

(56) References Cited

U.S. PATENT DOCUMENTS 3,605,579 A 9/1971 Heltzel
3,775,018 A * 11/1973 Barton ..... E01C 19/43 299/36.1

(Continued)

FOREIGN PATENT DOCUMENTS

EP 1234914 A2 8/2002
EP 1841637 B1 3/2011

OTHER PUBLICATIONS

European Search Report in corresponding European Patent Application No. EP 14196502, dated Apr. 15, 2015, 3 pp.

*Primary Examiner* — Raymond W Addie
(74) *Attorney, Agent, or Firm* — Lucian Wayne Beavers; Patterson Intellectual Property Law PC

(57) ABSTRACT

Texture curing machine for the subsequent treatment of freshly produced concrete layers, in particular concrete pavements, of a specified width, comprising a machine frame supported by ground-engaging units, where working devices are attached at the machine frame in a stationary fashion or movable transverse to the working direction, and the working devices comprise texturing devices for applying a texture into the not yet hardened surface of the concrete layer and/or spraying devices for discharging a curing agent, said working devices acting on the concrete layer in longitudinal direction or in transverse direction to the working direction, it is provided for the following features to be achieved: that the working devices for applying either a texture or a curing agent comprise both a working device acting in longitudinal direction and stationary in operation and a working device movable to and fro across the width of the concrete layer, where each is alternately transferable from a resting position into an operating position in which the working devices do not collide with one another.

20 Claims, 7 Drawing Sheets

(56) References Cited

U.S. PATENT DOCUMENTS 3,850,541 A * 11/1974 Baillet ..... E01C 19/407
404/114
4,318,631 A * 3/1982 Vickers ..... E01C 19/43
404/118
6,471,442 B1 * 10/2002 Deeb ..... E01C 19/40
404/105
6,497,531 B2 * 12/2002 Sipherd ..... E01C 23/03
222/526
7,121,761 B2 * 10/2006 Woodruff ..... E01C 11/24
404/17
7,517,171 B2 * 4/2009 Coats ..... E01C 19/43
404/89
7,721,831 B2 5/2010 Smolders et al.
8,118,518 B2 * 2/2012 Guntert, Jr. ..... E01C 19/4853
404/100

* cited by examiner

TEXTURE CURING MACHINE AS WELL AS METHOD FOR THE SUBSEQUENT TREATMENT OF A FRESHLY PRODUCED CONCRETE LAYER

BACKGROUND OF THE INVENTION

1. Field of the Invention

The invention relates to a texture curing machine, as well as to a method.

2. Description of the Prior Art

Such construction machines are known, for example, from EP 1 841 637 A (U.S. Pat. No. 7,721,831) in the embodiment of a brush spraying machine, which can be used to texture a newly produced concrete pavement of a road surface by means of, for example, a brush assembly, and to subsequently spray said concrete pavement with a liquid curing agent by means of a spraying assembly.

During the production of a concrete surface, in particular during the construction of concrete road surfaces, the concrete is generally paved to the required shape and position by a slipform paver and, for this purpose, is smoothed by means of a smoothing device, such as a transverse smoother. In some cases, an additional longitudinal smoother is used.

Prior to the application of the curing agent by the texture curing machine, the surface must be given a finishing surface treatment with a surface texture conforming to the intended use. It is thus intended to increase the skid resistance and riding comfort and to reduce the tire-pavement noise.

The concrete surface must be protected against drying out immediately after production. The customary method is to spray a curing agent.

Regarding texturing of the concrete surfaces, clients have different requirements in terms of the type of texture to be applied.

As a result, it may be necessary for the texture curing machines to be converted in a time-consuming procedure in order to achieve a specified texture depending on the client's specification. A further disadvantage is created by the fact that the conversion kits must be kept on hand separately.

The same applies to spraying the curing agent.

A further disadvantage is created by the fact that, after conversion of the machines, the texturing devices are mostly positioned in front of or behind the machine frame which, when starting and braking the texture curing machine, causes the pitching or tilting movements of the machine frame about an axis extending essentially parallel to the ground and transverse to the working direction to be reinforced due to the mass inertias and the suspension of the machine frame via lifting columns. This is of disadvantage in particular because, as a result, the texturing tools alter their height of engagement relative to the concrete surface, and texturing is therefore performed at different heights in the acceleration and braking phases.

SUMMARY OF THE INVENTION

It is therefore the object of the invention to create a texture curing machine as well as a method for the subsequent treatment of freshly produced concrete layers which are capable to easily perform different texturing and/or spraying operations without requiring time-consuming conversion times.

The invention advantageously provides for the working devices for applying either a texture or a curing agent to comprise both a working device acting in longitudinal direction and stationary in operation and a working device movable to and fro across the width of the concrete layer, where each is alternately transferable from a resting position into an operating position in which the working devices do not collide with one another. It is thus possible to provide both working devices acting in longitudinal direction of the concrete layer and working devices acting in transverse direction of the concrete layer, each serving the same purpose, namely, to either apply a texture or to apply a curing agent. They are alternatively transferable into a resting position so that they can collide neither with the alternative working device for the same intended use nor with the working devices for a different intended use.

Depending on the service contract, the texture curing machine can therefore be converted in a minimum of time, allowing any combination in terms of the application of a curing agent in longitudinal or in transverse direction of the concrete layer and the application of a texture in transverse or in longitudinal direction to be performed in a flexible fashion.

The working devices for applying either a texture or a curing agent may each be attached at the machine frame both stationary in operation as well as movable transverse to the working direction.

It is preferably intended for the working device stationary in operation to be attached at the machine frame to pivot from an operating position into a resting position in such a fashion that the movable working device is movable to and fro, without a collision occurring, relative to the working device being in resting position or, without a collision occurring, underneath the working device being in resting position.

A working device movable for the application of a texture may be a transverse texturing device which is movable into a resting position in which the transverse texturing device is disengaged from the concrete layer.

The invention advantageously provides, in particular, for the working devices to comprise both a longitudinal texturing device and a transverse texturing device movable to and fro across the width of the concrete layer. Both texturing devices are alternately transferable from a resting position into a working position in which, in both cases, the texturing devices do not collide with one another.

It is thus possible to bring either the longitudinal texturing device or the transverse texturing device into their respective resting positions and to perform the texturing operation using the other texturing device without extended conversion times being required.

It is preferably intended for the longitudinal texturing device to be attached at the machine frame to pivot from an operating position into a resting position in such a fashion that the transverse texturing device is movable to and fro underneath the longitudinal texturing device being in resting position. In this arrangement, the longitudinal texturing device is pivoted upwards into a resting position so that the transverse texturing device can be moved across the width of the pavement surface without a collision occurring. Conversion of the texture curing machine to the respective other operating mode can be performed in a minimum of time.

The movable working device, in particular the transverse texturing device, can be moved into a resting position in which the working device is disengaged from the concrete layer. The transverse texturing device is thus outside the width of the pavement surface so that it cannot collide with another working device, in particular a longitudinal texturing device in the pivoted-down position.

The transverse texturing device is preferably movable to and fro transverse to the working direction on a rail guide which, at no less than one lateral end beyond the width of the concrete layer, features a height offset which raises the transverse texturing device, at said end, into the resting position. In raised position, it is ensured that the transverse texturing device comes in touch neither with the concrete layer nor with the longitudinal texturing device.

In a preferred embodiment, it is intended for the machine frame to comprise longitudinal members extending parallel to the working direction and transverse members extending transverse to the working direction, where the transverse members extending transverse to the working direction are telescopable for variable adjustment of the track width of the ground-engaging units and for adjustment to the width of the concrete layer.

It is preferably intended for the working devices to comprise a longitudinal spraying device and/or a transverse spraying device movable to and fro across the working width of the concrete pavement.

The machine may thus comprise a longitudinal spraying device or a transverse spraying device or both spraying devices.

It may in particular be intended for the spraying devices to comprise a longitudinal spraying device stationary in operation and/or a transverse spraying device movable to and fro across the working width of the concrete layer, with the longitudinal spraying device being attached at the machine frame to pivot from an operating position into a resting position serving as transport position.

On the one hand, pivoting the longitudinal spraying device, which extends across the width of the machine, serves to maintain a narrow machine width for transport so that, with the ground-engaging units turned about 90°, the machine is suitable for road transport on a special transport vehicle.

On the other hand, pivoting the longitudinal spraying device serves to enable the transverse spraying device to be moved across the width of the machine without a collision occurring.

It may be intended for the transverse spraying device, in the operating position, to be arranged in the extended axis of the transverse texturing device preferably lagging in working direction or on one side or both sides next to the transverse texturing device and to be movable in conjunction with the transverse texturing device.

It is preferably intended for the transverse and longitudinal texturing devices to be arranged on a level with ground-engaging units arranged laterally at the machine frame or between front and rear ground-engaging units as seen in working direction.

The machine frame may be supported by two individual, longer ground-engaging units, each being arranged laterally, or by a total of four ground-engaging units, in which design two ground-engaging units running behind one another may be arranged on each side of the machine frame. The ground-engaging units are connected to the machine frame via lifting columns which enable a height adjustment of the machine frame to be performed relative to the ground surface. It is preferred for the transverse and longitudinal texturing devices to be arranged essentially centrally to the individual ground-engaging units arranged on both sides or between the respective front and rear ground-engaging units. This creates the advantage of the texturing tools experiencing a slight change in height only when starting or braking the machine. The pitching movements of the tools occurring during starting or braking are thus minimized.

The transverse and/or longitudinal texturing devices are preferably positioned inside the machine frame in such a fashion that their mass distribution in working direction relative to the center of the lateral ground-engaging units or the center between the front and rear ground-engaging units is equalized in such a fashion that, when accelerating or braking, only a low moment of inertia is acting on the machine frame.

It is preferably intended for the transverse and longitudinal texturing devices to comprise tools which are attached by means of a quick-change system. It is thus possible to exchange the tools without the need for extended setup times or to exchange defective tools without incurring a significant time loss.

The spraying devices preferably comprise spraying nozzles which are selectable via a quick-change device so that the spraying behaviour of the spraying devices can be altered, or a defective or blocked nozzle can be replaced with another one in a simple fashion.

It is furthermore possible, via a simple attachment of the spraying nozzles, for example, along a rail, to adjust their mutual distance.

According to a method for the subsequent treatment of freshly produced concrete layers, the invention advantageously provides for a working device stationary in operation and a working device movable to and fro across the width of the concrete layer for applying either a texture or a curing agent to be used alternatively in that the working devices, when not in use, are each alternately transferred from an operating position into resting positions in which they do not collide with one another.

In the following, embodiments of the invention are explained in more detail with reference to the drawings.

BRIEF DESCRIPTION OF THE DRAWINGS

The following is shown.

DETAILED DESCRIPTION

Figure 1:
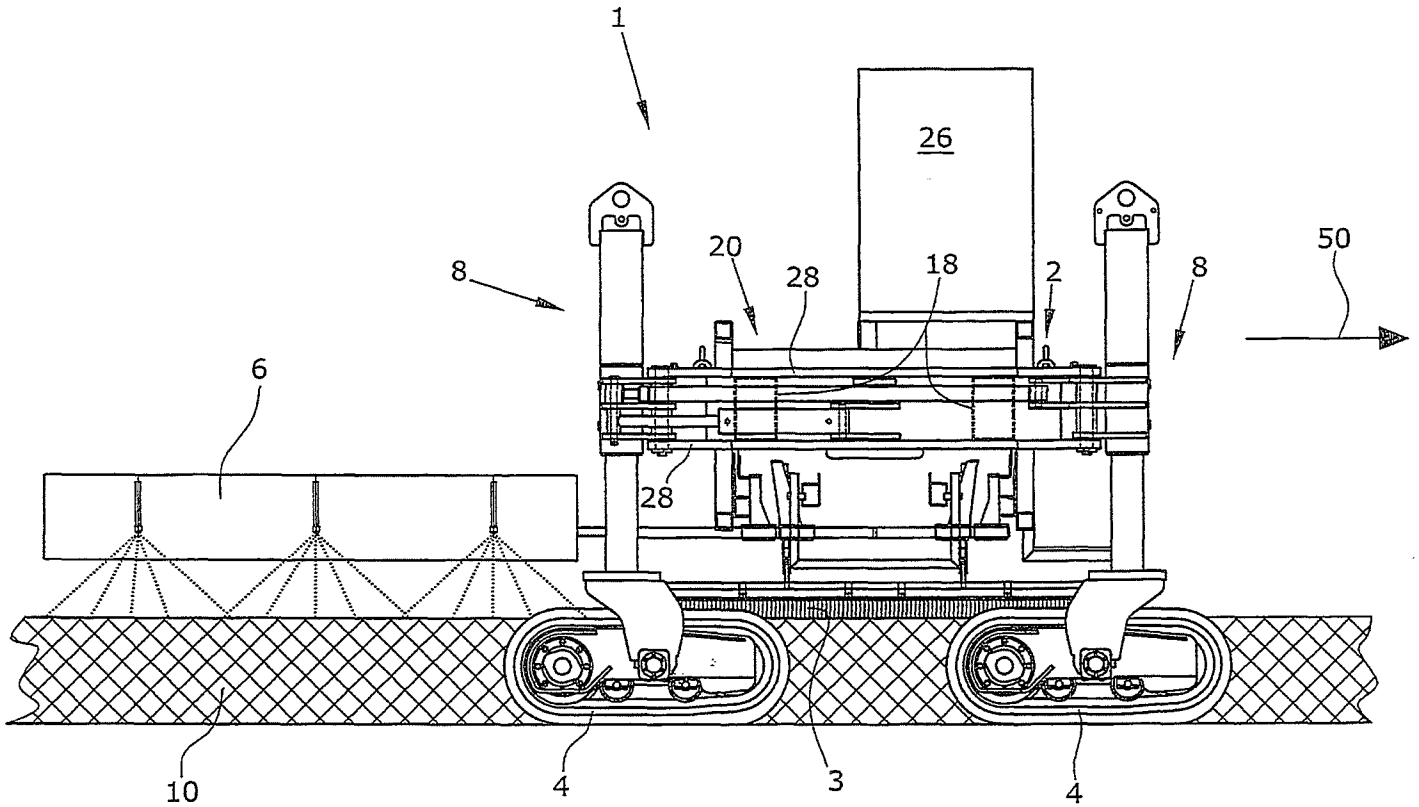
FIG. 1 a texture curing machine in accordance with prior art.

The Prior Art Device of FIG. 1

FIG. 1 shows a texture curing machine 1 in the embodiment of a brush spraying machine as it is known from EP 1 841 637 A (U.S. Pat. No. 7,721,831). The texture curing machine 1 can texturize a newly produced concrete layer 10, such as a road surface, by means of a transverse texturing device 3, for example, a brush assembly, and subsequently spray said concrete layer with a liquid curing agent by means of a spraying assembly 6.

The machine frame 2 features a depth suitable for transport on a transport vehicle so that the machine can be transported to the operating site by road on the transport vehicle. The machine frame features a multiple of the width in comparison to the depth with, for example, widening elements being usable or the machine frame 2 being telescopable for adjustment to a specific pavement width. In this arrangement, a pavement width of, for example, up to 18 m can be bridged in the working position shown in FIG. 1. The working direction is indicated in each of the drawings by an arrow 50.

The machine frame 2 comprises longitudinal members 28 extending parallel to the working direction 50 and transverse members 18 extending transverse to the working direction 50, where the transverse members 18 extending transverse to the working direction are telescopable for variable adjustment of the track width of the ground-engaging units and for adjustment to the width of the concrete layer 10.

The texture curing machine 1 comprises a chassis with multiple wheels and/or track units 4 which support the machine frame 2 in a height-adjustable manner via lifting columns 8.

The use of a total of four ground-engaging units 4 at the lateral ends of the texture curing machine 1 has the advantage of higher stability, with the arrangement of the working devices, in particular the texturing device 3, centrally between the ground-engaging units 4 as seen in the direction of travel 50 offering the advantage of the influence of forces of mass inertia on the machine frame 2 being minimized when starting or braking the texture curing machine 1. Moreover, slight pitching movements occurring nonetheless have a less pronounced effect on the position of the texturing device relative to the concrete surface.

The wheels or track units 4 can, in particular in the case of four track units 4, be transferred from a working position shown in FIG. 1 into a transport position by means of a swivel gear. In working position, as shown in FIG. 1, the track units 4 extend parallel to cross members 28 of the machine frame 2. In transport position, the track units 4 extend parallel to the longitudinal extension of the machine frame 2, namely, pivoted about 90° and transverse to the longitudinal members 28.

The track units 4 are hydraulically driven, steerable and adjustable in height.

The Invention of FIGS. 2-6

Figure 2:
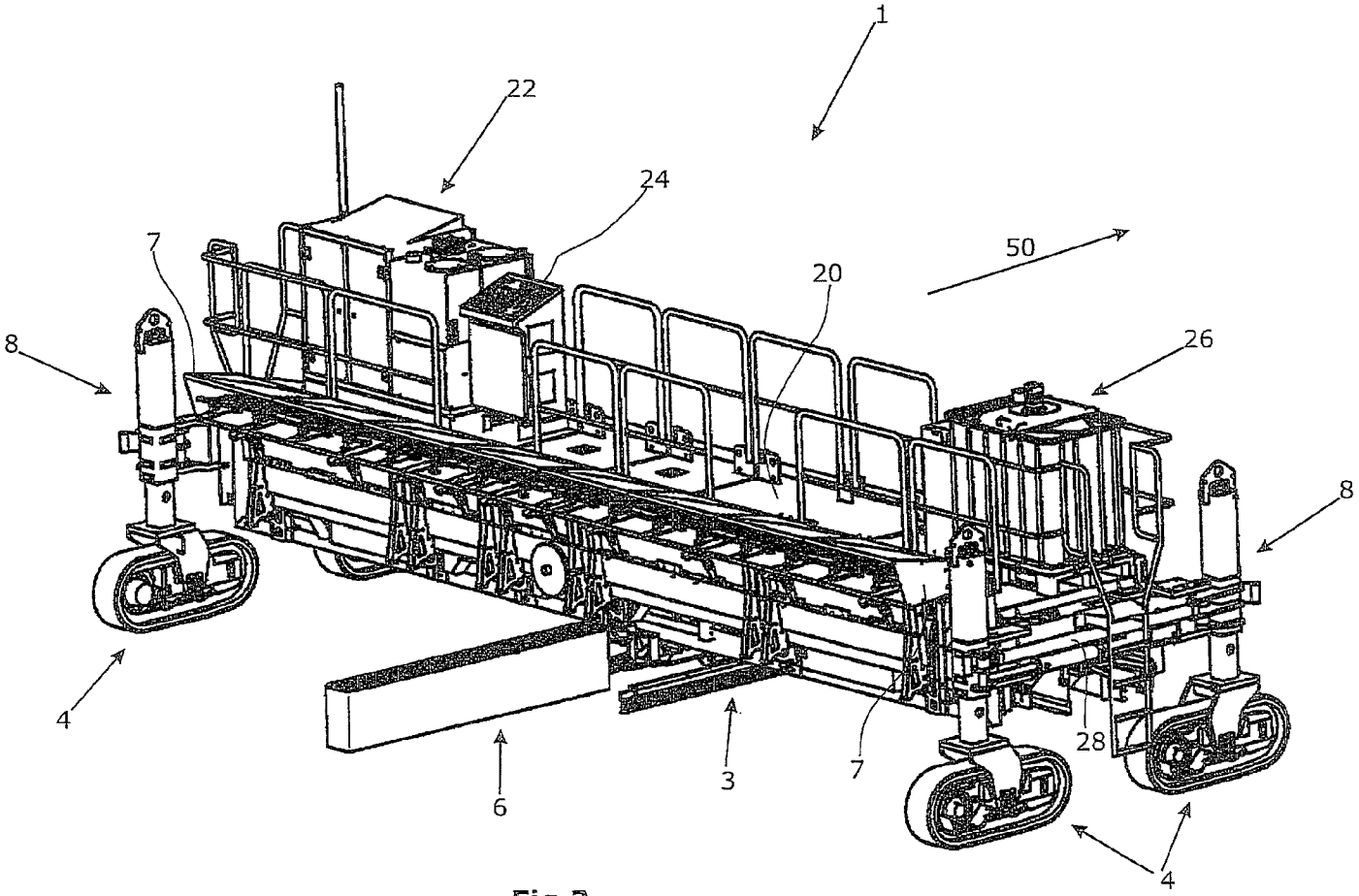
FIG. 2 a perspective view of a texture curing machine according to the invention with activated transverse texturing device and transverse spraying device and deactivated longitudinal texturing device and longitudinal spraying device, FIG. 3*a* a partial view of the texture curing machine according to the invention with activated transverse texturing device and deactivated longitudinal texturing device, and with activated longitudinal spraying device and removed or deactivated transverse spraying device, FIG. 3*b* a partial view of the texture curing machine according to the invention with activated transverse texturing device and deactivated longitudinal texturing device, and with deactivated longitudinal spraying device and mounted transverse spraying device, FIG. 4 a perspective view of the machine according to the invention with activated longitudinal spraying device, FIG. 5 the texture curing machine according to the invention with activated longitudinal texturing device and activated longitudinal spraying device, and FIG. 6*a* enlarged cut-away partial view along line VI-VI in FIG. 3*a*.

FIG. 2 shows a perspective view of an improved texture curing machine 1. The drive unit 22 with a control panel 24 is arranged on the left side as seen in the direction of travel 50. Both are arranged on a platform 20 of the machine frame 2 which is walkable and comprises, on its side opposite the drive unit 22, a spraying agent tank 26.

The transverse spraying device 6 is attached at a transverse drive movable crosswise over the concrete layer 10 or the pavement width, respectively. Furthermore, the transverse texturing device 3 comprised of, for example, a brush assembly, is also attached at the transverse drive. In this arrangement, as can best be inferred from FIG. 3*a*, the transverse texturing device 3 is guided across the width of the concrete layer 10 by a rail-guided slide 12 provided with a transverse drive.

The transverse spraying device 6, as depicted in FIG. 2, is attached at the transverse drive in a removable fashion. It can thus be loosened from the transverse drive when converting to a longitudinal spraying device 7.

Alternatively, the transverse spraying device 6 may also be attached at the transverse texturing device 3, in which design it is also possible for two spraying devices 6 to be arranged in front of and behind the transverse texturing device 3 as seen in the direction of movement of the transverse texturing device 3 transverse to the concrete layer 10 or pavement, respectively.

Figure 3A:
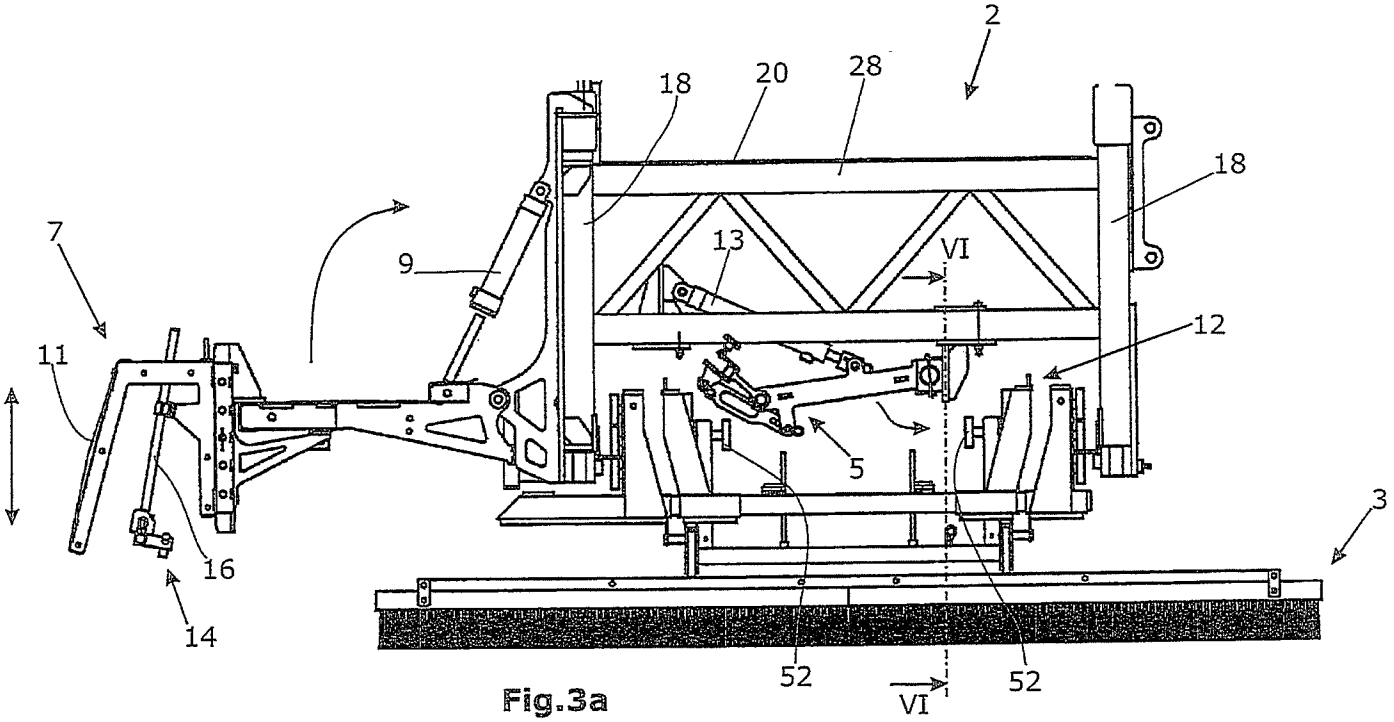

FIG. 3*a* shows the transverse texturing device 3 in activated condition and in working position while the longitudinal texturing device 5 has assumed a resting position in which it collides neither with the transverse texturing device 3 nor its slide 12.

The transverse and longitudinal texturing devices 3, 5 comprise a quick-change device for tools so that different brushes or tools, such as steel tines or synthetic brushes, can be used within a short period of time.

In the embodiment of FIG. 3*a*, the transverse texturing device in working position is combined with a longitudinal spraying device 7 in working position. The longitudinal spraying device 7 can also be pivoted, by means of a piston-cylinder unit 9, into a resting position which can be inferred from FIG. 2 and in which the longitudinal spraying device 7 cannot collide with the transverse spraying device 6. The resting position of the longitudinal spraying device 7 can simultaneously be used for transport as in this position the overall depth of the machine still allows for it to be suitable for transport on a flatbed truck.

In FIG. 3*a*, the lateral section of the wind guard 11 has been removed in order to provide a view of the nozzle arrangement 14 and their holder 16.

The longitudinal spraying device 7 is height-adjustable by, for example, a magnitude of approx.±150 mm. Spraying nozzles 14 are arranged at the lower end of a holder 16. A turret for different spraying nozzles is preferably arranged at each spraying nozzle position so that the longitudinal spraying device (as also in case of a transverse spraying device 6) can quickly be adjusted to a different type of nozzle, or a defective or blocked nozzle can be replaced with another one.

Figure 3B:
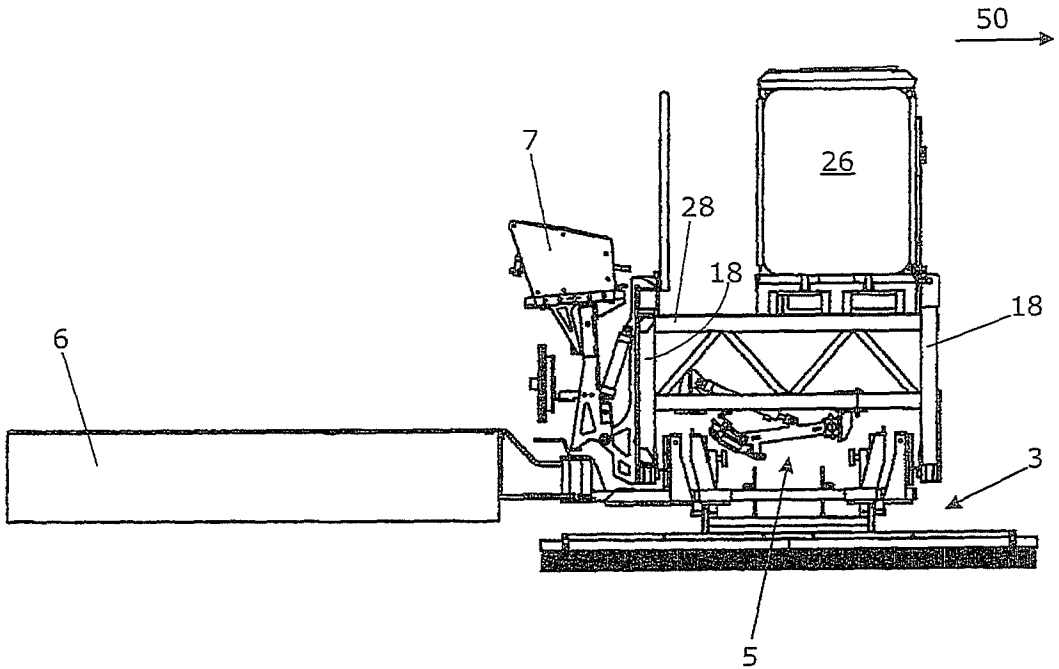

FIG. 3*b* shows the combination of the transverse texturing device 3 and a transverse spraying device 6, where the longitudinal texturing devices 5 and the longitudinal spraying device 7 are in resting position.

Figure 4:
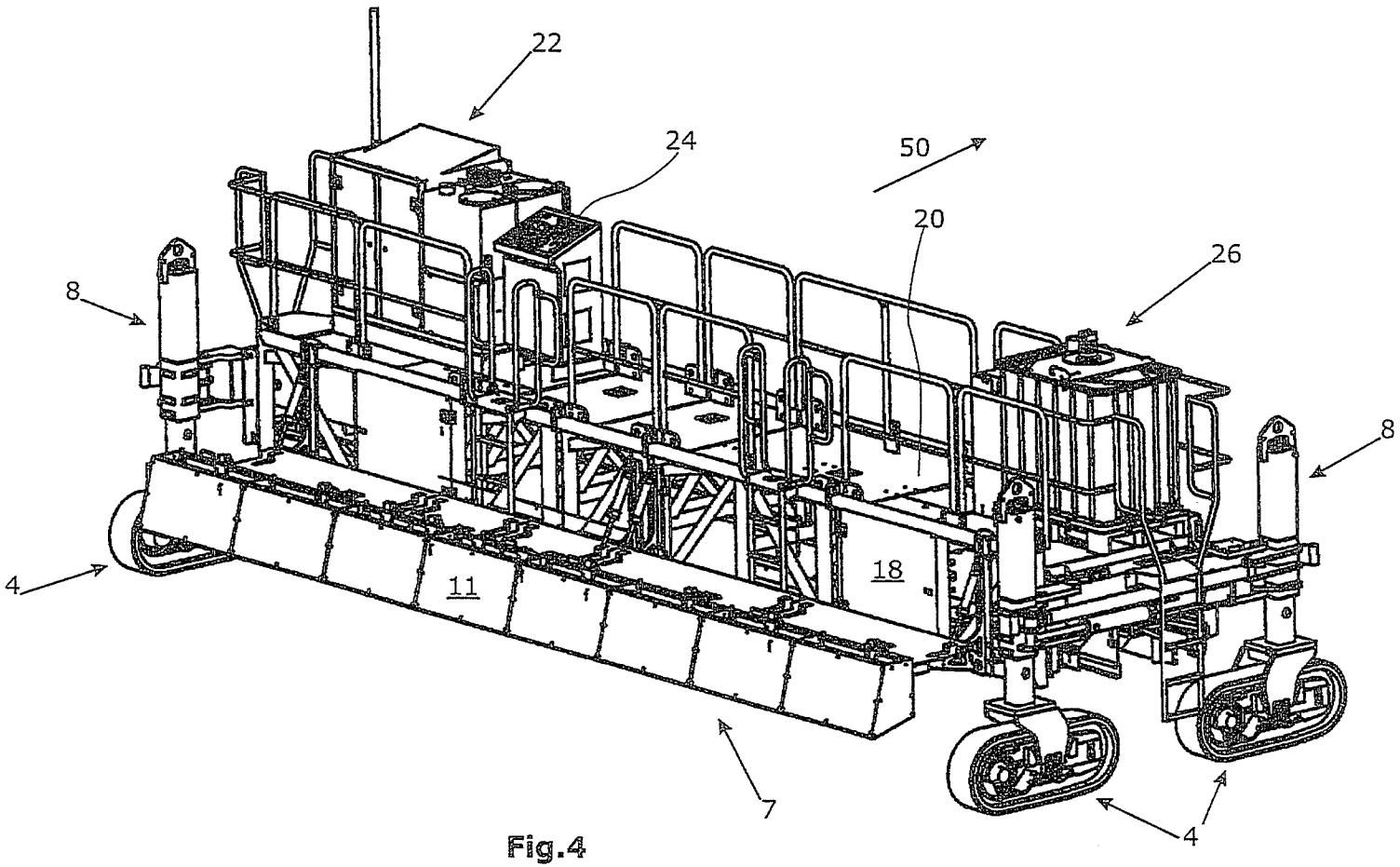

FIG. 4 shows a perspective illustration of the machine with activated longitudinal spraying device 7 in working position which is enclosed by a wind guard 11.

Figure 5:
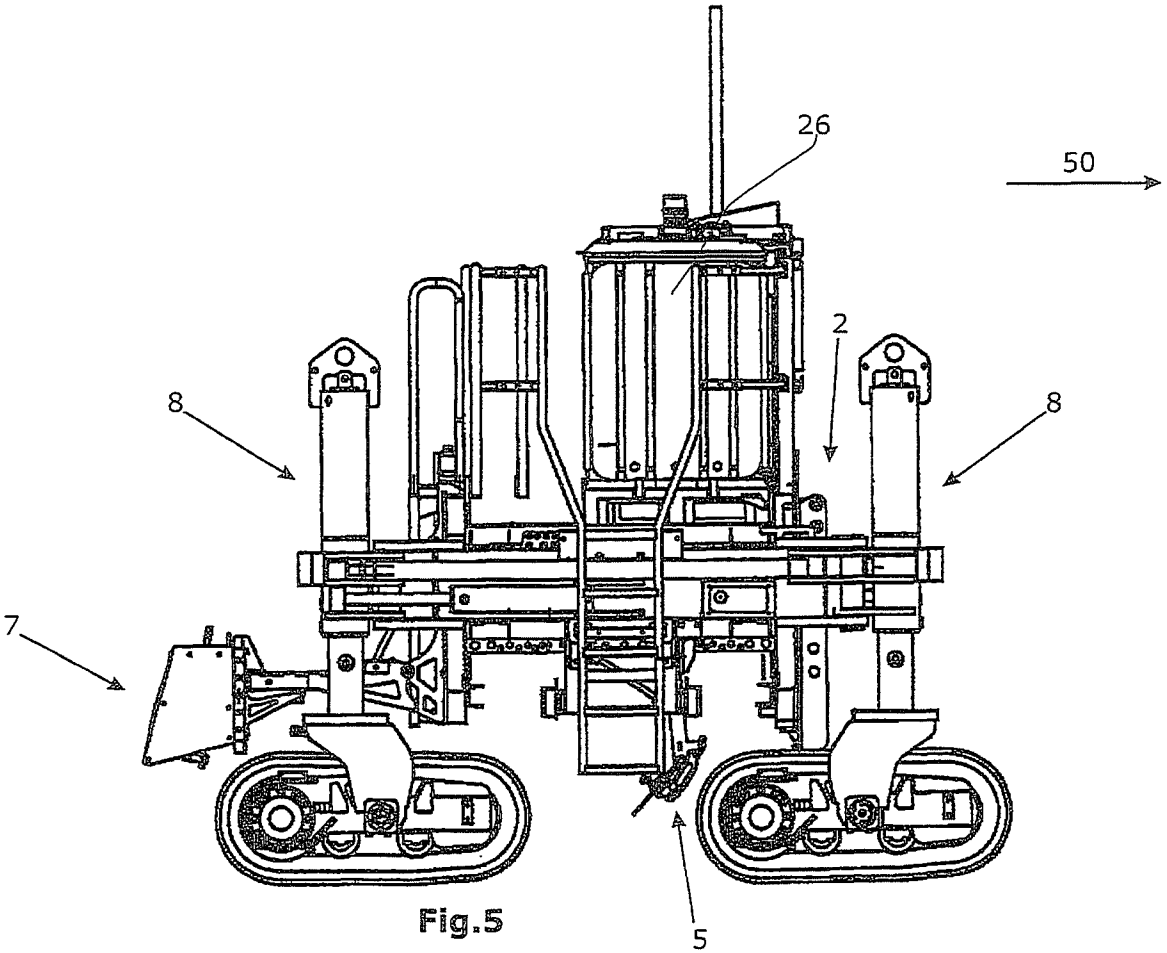

FIG. 5 shows a side view of the texture curing machine 1 according to the embodiment of FIG. 4. In this combination, the longitudinal texturing device 5 and the longitudinal spraying device 7 are in working position while the transverse texturing device 3 is in a non-visible, raised resting position at one of the lateral ends of the texture curing machine 1.

To this effect, the rail guide of the slide 12 is raised by a specified magnitude in a section laterally next to the concrete layer 10 so that the transverse texturing device 3 can be transferred into a raised condition into a resting position next to the concrete layer 10 or pavement, respectively. In said resting position of the transverse texturing device 3, the longitudinal texturing device 5 can be pivoted in its working position without colliding with the transverse texturing device 3.

The longitudinal texturing device 5 can be transferred from the working position into the resting position shown, for example, in FIGS. 3*a* and 3*b* and vice-versa by means of piston-cylinder units 13.

It is understood that any combination of the working devices 3, 5, 6, 7 working in longitudinal or in transverse direction is possible.

Figure 6A:
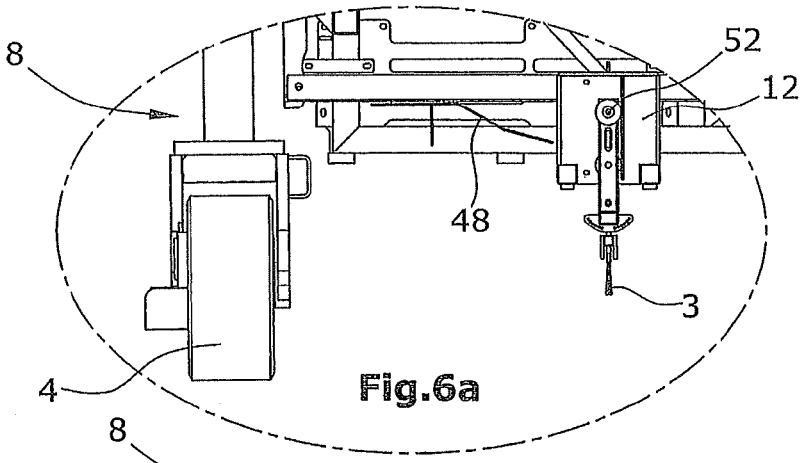
FIG. 6*b* enlarged cut-away partial view along line VI-VI in FIG. 3*a*.
FIG. 6*c* enlarged cut-away partial view along line VI-VI in FIG. 3*a*.
Figure 6B:
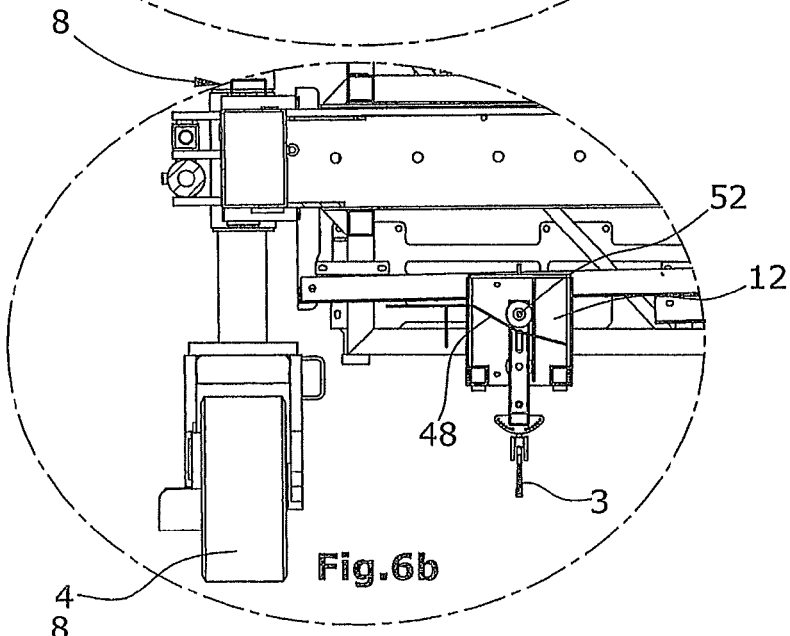
Figure 6C:
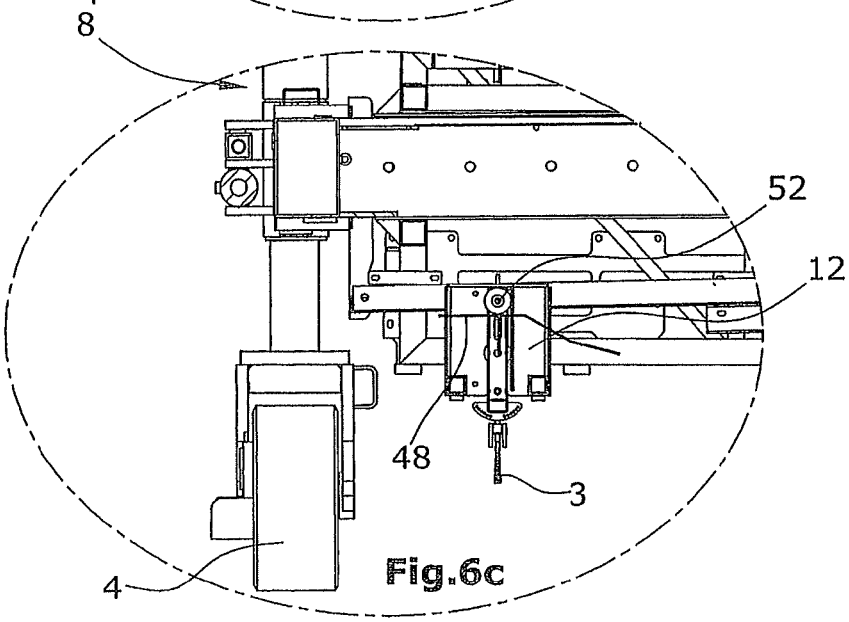

FIGS. 6*a* to 6*c* show a rail guide 48 which enables the transverse texturing device 3 to be raised, by means of a roller guide 52, into a resting position outside the concrete layer 10, in which case preferably only the transverse texturing device 3 is raised.

What is claimed is:

1. A texture curing machine for the subsequent treatment of a freshly produced concrete layer having a width and extending longitudinally in a working direction, comprising:

a machine frame;

a plurality of ground engaging units supporting the machine frame;

at least one longitudinal working device attached to the machine frame and configured to treat the concrete layer in a longitudinal direction parallel to the working direction, the longitudinal working device including a resting position and an operating position, the longitudinal working device being stationary relative to the machine frame when in its operating position;

at least one transverse working device attached to the machine frame and configured to treat the concrete layer in a transverse direction transverse to the working direction, the transverse working device including a resting position and an operating position, the transverse working device being movable to and fro across the width of the concrete layer when in its operating position;

wherein both of the longitudinal and transverse working devices include a texturing device configured to apply a texture into a not yet hardened surface of the concrete layer or both of the longitudinal and transverse working devices include a spraying device configured to discharge a curing agent onto the not yet hardened surface of the concrete layer; and each of the longitudinal and transverse working devices being alternately transferable from its respective resting position to its respective operating position, with the other of the longitudinal and transverse working devices being in its respective resting position, such that the longitudinal and transverse working devices do not collide with one another.

2. The texture curing machine of claim 1, wherein:

the at least one longitudinal working device comprises both a longitudinal texturing device and a longitudinal spraying device; and the at least one transverse working device comprises both a transverse texturing device and a transverse spraying device.

3. The texture curing machine of claim 1, wherein:

the transverse working device is a transverse texturing device, and in its resting position the transverse texturing device is disengaged from the concrete layer.

4. The texture curing machine of claim 1, wherein:

the transverse working device when in its resting position is located outside the width of the concrete layer.

5. The texture curing machine of claim 1, wherein:

the transverse working device is a transverse texturing device including a rail guide, the rail guide having at least one end extending beyond the width of the concrete layer and including a height offset, and the transverse texturing device is movable transversely on the rail guide onto the height offset which raises the transverse texturing device into its resting position.

6. The texture curing machine of claim 1, wherein:

the machine frame includes longitudinal members extending parallel to the working direction and transverse members extending transverse to the working direction, the transverse members being telescopable for variable adjustment of a track width of the ground engaging units and for adjustment of the width of the concrete layer.

7. The texture curing machine of claim 1, wherein:

the at least one longitudinal working device comprises a longitudinal spraying device pivotally attached to the machine frame to pivot from its operating position to its resting position, the resting position of the longitudinal spraying device also serving as a transport position; and the at least one transverse working device comprises a transverse spraying device.

8. The texture curing machine of claim 1, wherein:

the at least one longitudinal working device comprises both a longitudinal texturing device and a longitudinal spraying device;

the at least one transverse working device comprises both a transverse texturing device and a transverse spraying device; and wherein the transverse spraying device in its operating position is arranged along an extended axis of the transverse texturing device and is movable in conjunction with the transverse texturing device.

9. The texture curing machine of claim 8, wherein:

the transverse spraying device lags the transverse texturing device relative to the working direction.

10. The texture curing machine of claim 1, wherein:

the at least one longitudinal working device comprises a longitudinal texturing device;

the at least one transverse working device comprises a transverse texturing device; and a center of mass of each of the longitudinal texturing device and the transverse texturing device is located transversely between the ground engaging units and substantially centrally between a front and a rear of the ground engaging units relative to the working direction.

11. The texture curing machine of claim 1, wherein:

the at least one longitudinal working device comprises a longitudinal texturing device;

the at least one transverse working device comprises a transverse texturing device;

the plurality of ground engaging units includes front ground engaging units and rear ground engaging units; and a center of mass of each of the longitudinal texturing device and the transverse texturing device is located between the front ground engaging units and the rear ground engaging units relative to the working direction.

12. The texture curing machine of claim 1, wherein:

the at least one longitudinal working device comprises a longitudinal texturing device;

the at least one transverse working device comprises a transverse texturing device; and a mass distribution of each of the longitudinal texturing device and the transverse texturing device extends both forward and rearward of a center of gravity of the texture curing machine.

13. The texture curing machine of claim 1, wherein:

the at least one longitudinal working device comprises a longitudinal texturing device;

the at least one transverse working device comprises a transverse texturing device; and the texturing devices each comprise texturing tools replaceably attached to the respective texturing device.

14. The texture curing machine of claim 1, wherein:

the at least one longitudinal working device comprises a longitudinal spraying device;

the at least one transverse working device comprises a transverse spraying device; and the spraying devices each comprise spraying nozzles replaceably attached to the respective spraying device.

15. The texture curing machine of claim 1, wherein:

the at least one longitudinal working device comprises a longitudinal spraying device;

the at least one transverse working device comprises a transverse spraying device; and the spraying devices each comprise spraying nozzles a mutual distance of which is adjustable relative to the concrete layer.

16. A texture curing machine for the subsequent treatment of a freshly produced concrete layer having a width and extending longitudinally in a working direction, comprising:

a machine frame;

a plurality of ground engaging units supporting the machine frame;

at least one longitudinal working device attached to the machine frame and configured to treat the concrete layer in a longitudinal direction parallel to the working direction, the longitudinal working device including a resting position and an operating position, the longitudinal working device being stationary relative to the machine frame when in its operating position;

at least one transverse working device attached to the machine frame and configured to treat the concrete layer in a transverse direction transverse to the working direction, the transverse working device including a resting position and an operating position, the transverse working device being movable to and fro across the width of the concrete layer when in its operating position;

each of the longitudinal and transverse working devices including either a texturing device configured to apply a texture into a not yet hardened surface of the concrete layer, or a spraying device configured to discharge a curing agent onto the not yet hardened surface of the concrete layer; and each of the longitudinal and transverse working devices being alternately transferable from its respective resting position to its respective operating position, with the other of the longitudinal and transverse working devices being in its respective resting position, such that the longitudinal and transverse working devices do not collide with one another;

wherein the longitudinal working device is pivotally attached to the machine frame such that the longitudinal working device pivots from its operating position to its resting position; and wherein when the longitudinal working device is in its resting position, the transverse working device is movable to and fro underneath the longitudinal working device without a collision occurring between the transverse working device and the longitudinal working device.

17. A method for treatment of a freshly produced concrete layer having a width and extending longitudinally in a working direction, comprising:

(a) providing a texture curing machine self-propelled in the working direction and including a machine frame, a longitudinal working device and a transverse working device, the longitudinal working device being attached to the machine frame and having an operating position stationary relative to the machine frame to treat the concrete layer in a longitudinal direction parallel to the working direction, and the transverse working device being attached to the machine frame and having an operating position movable to and fro across the width of the concrete layer to treat the concrete layer in a transverse direction transverse to the working direction, both of the longitudinal and transverse working devices including texturing devices configured to apply a texture into a not yet hardened surface of the concrete layer or both of the longitudinal and transverse working devices including spraying devices configured to discharge a curing agent onto the not yet hardened surface of the concrete layer; and (b) alternatively operating one of the longitudinal working device and the transverse working device, with the other of the longitudinal working device and the transverse device in a respective resting position, wherein the working devices do not collide with each other.

18. The method of claim 17, wherein:

in step (a) the working devices include spraying devices; and further comprising pivoting the longitudinal spraying device from its operating position into its resting position, thereby allowing collision-free operation of the transverse spraying device.

19. The method of claim 17, wherein:

in step (a) the working devices include spraying devices; and further comprising pivoting the longitudinal spraying device from its operating position into its resting position, the resting position of the longitudinal spraying device further serving as a transport position of the longitudinal spraying device for transport of the texture curing machine.

20. A method for treatment of a freshly produced concrete layer having a width and extending longitudinally in a working direction, comprising:

providing a texture curing machine self-propelled in the working direction and including a machine frame, a longitudinal working device and a transverse working device, the longitudinal working device being attached to the machine frame and having an operating position stationary relative to the machine frame to treat the concrete layer in a longitudinal direction parallel to the working direction, and the transverse working device being attached to the machine frame and having an operating position movable to and fro across the width of the concrete layer to treat the concrete layer in a transverse direction transverse to the working direction;

alternatively operating one of the longitudinal working device and the transverse working device, with the other of the longitudinal working device and the transverse device in a respective resting position, wherein the working devices do not collide with each other; and pivoting the longitudinal working device from its operating position to its resting position, such that the transverse working device is movable to and fro transversely underneath the longitudinal working device without a collision occurring.

* * * * *